US006051075A

United States Patent [19]

Kochergin et al.

[11] Patent Number: 6,051,075

[45] Date of Patent: Apr. 18, 2000

[54] PROCESS FOR SUGAR BEET JUICE CLARIFICATION

[75] Inventors: Vadim N. Kochergin; Lawrence Velasquez, both of Twin Falls, Id.

[73] Assignee: Amalgamated Research, Inc., Twin Falls, Id.

[21] Appl. No.: 08/751,044

[22] Filed: Nov. 15, 1996

[51] Int. Cl.[7] ..... C13D 1/08; C13D 3/00; C13D 3/16; C13F 1/08

[52] U.S. Cl. ..... 127/42; 127/48; 127/50; 127/53; 127/55; 127/57

[58] Field of Search ..... 127/42, 48, 50, 127/53, 55, 57

[56] References Cited

U.S. PATENT DOCUMENTS 3,926,662 12/1975 Rundell et al. ..... 127/48

3,963,513 6/1976 Casey ..... 127/11

4,135,946 1/1979 Casey et al. ..... 127/11

5,554,227 9/1996 Kwok et al. ..... 127/58

*Primary Examiner*—Mark L. Bell

*Assistant Examiner*—Patricia L. Hailey

*Attorney, Agent, or Firm*—Trask, Britt & Rossa

[57] ABSTRACT

Diffusion juice of a sugar plant is heated under stable sucrose conditions, notably alkaline pH, and held above 70° C. for sufficient duration to effect significant agglomeration. The agglomerated particulates are removed by phase separation procedures, leaving a clarified juice containing a very low, typically 0.1–0.5 volume percent, solids load.

19 Claims, 1 Drawing Sheet

PROCESS FOR SUGAR BEET JUICE CLARIFICATION

BACKGROUND OF THE INVENTION

1. Field

This invention relates to sugar extraction processes. It is particularly directed to the clarification of raw juice extracted from agricultural sources, such as sugar beets, prior to purification of the sucrose contained in that juice.

2. State of the Art

In the conventional production of crystallized sucrose (sugar), a "raw juice" is initially obtained by diffusion of soluble material from beets, cane or other sources. The raw juice is then partially purified. The purpose of this initial purification step is to remove a significant portion of the "nonsucrose" fraction from the juice. The partially purified juice exhibits improved subsequent processing, yields a higher recovery of crystallized product and improves product quality with respect to color, odor, taste and solution turbidity. As applied to sugar beets, raw beet juice is usually obtained as a result of countercurrent extraction of sliced beets with hot water. This process results in a high load of suspended solids, typically, 3–4 volume percent.

The most commonly used method for raw beet juice purification is ubiquitous, and is based upon the addition of lime and carbon dioxide. The initial steps of this method occur prior to crystallization, during a phase commonly referred to as the "beet end" of the process. The sugar beets are typically diffused with hot water to extract a "raw juice" or "diffusion juice". The raw juice contains (1) sucrose (2) nonsucroses and (3) water. The term "nonsucroses" includes all of the sugar beet-derived substances, including both dissolved and undissolved solids, other than sucrose, in the juice. Other constituents which may be present in the raw juice are not of concern to the present invention.

The raw juice is heated to high temperature, and a solution/suspension of calcium oxide and water (milk of lime) is added to the juice. The juice is then treated with carbon dioxide gas to precipitate the calcium oxide as calcium carbonate. This step is commonly called "first carbonation," and it is the foundation of the conventional purification scheme, resulting in a "first carbonation juice." During this step, various nonsucrose compounds, color etc. are removed or transformed by reaction with the lime or by absorption by the calcium carbonate precipitate.

Conventionally, the calcium oxide and the carbon dioxide are produced by heating limerock (calcium carbonate) in a high temperature kiln. The calcium carbonate decomposes to calcium oxide and carbon dioxide, which are then recombined in the first carbonation step. The resulting calcium carbonate "mud" is usually removed from the first carbonation juice by settling clarifiers or by appropriate filters. The resulting "lime waste" is difficult to dispose of and contains about 20 percent to 30 percent of the original raw juice non sucrose. The first carbonation juice is most commonly sent to a second carbon dioxide gassing tank (without lime addition). This gassing step is often referred to as "second carbonation." The purpose of the second carbonation step is to reduce the level of calcium present in the treated ("second carbonation") juice by precipitating the calcium ions as insoluble calcium carbonate. The calcium precipitates, often called "limesalts," can form a noxious scale in downstream equipment, such as evaporators. The second carbonation juice is usually filtered to remove the precipitated calcium carbonate.

In conventional processes, liming and carbonation are used to coagulate and chemically react with dissolved non-sugar components. Due to high suspended solids load, lime is often used excessively to provide enough calcium carbonate which serves as incompressible filter-aid in subsequent filtration. Thus, additional suspended solids load generally results in excess amounts of calcium carbonate waste. Production of lime and disposal of waste product create environmental problems, such as high carbon monoxide emissions, water contamination and the creation of odors related to decomposition of organic matter.

Various methods and equipment used for purifying raw sugar juice by ion exchange are disclosed in British Patent No. 1,043,102; U.S. Pat. Nos. 3,618,589; 3,785,863; 4,140,541; and 4,331,483. A proposed method of purification of raw sugar juice involving membrane ultrafiltration is disclosed in U.S. Pat. No. 4,432,806. A method and apparatus for chromatographic molasses separation are disclosed in U.S. Pat. No. 4,312,678. Other methods and apparatus using simulated moving bed chromatographic separators are disclosed in U.S. Pat. Nos. 2,985,589; 4,182,633; 4,412,866; and 5,102,553.

Juice subjected to conventional clarification is not easily purified by methods such as membrane filtration, ion-exchange, multimedia filtration, chromatography and other methods requiring relatively low suspended solids load. Juice treated with lime also has a relatively high hardness level which makes it difficult to treat directly in highly efficient separation methods such as chromatography.

Chemical treatment of juice has been proposed (U.S. Pat. No. 4,432,806) with prior mechanical separation of undissolved components. Low molecular weight non-sugars are converted to high molecular weight non-sugars and subsequently separated from sucrose by ultrafiltration, thereby enhancing sucrose purity. Mechanical removal of suspended solids is a difficult task to accomplish, however.

U.S. Pat. No. 5,544,227 discloses a procedure by which raw beet or cane juice is heated to 70–105° C. and vigorously mixed with a cationic flocculating agent prior to its introduction to a clarifier. Part of the flocculated suspended solids is settled in the clarifier. The clarifier overflow stream is fed to a membrane filtration unit where the rest of the colloidal material and suspended solids are removed. However, addition of a flocculent may adversely affect membrane performance. Moreover, heating of the juice results in significant losses of sucrose, due to inversion.

Commonly assigned U.S. Pat. No. 5,466,294 discloses a sugar beet juice purification process in which the traditional liming and carbonation purification procedures are replaced with ion exchange softening and chromatographic separation operations. The disclosure of the '294 patent is incorporated by reference as a part of this disclosure for its teachings concerning the state of the art in purifying diffusion juices generally. A description of conventional clarification technology, as applied to sugar beets, may be found in the book authored by R. A. McGinnis, "Beet Sugar Technology", Beet Sugar Development Foundation, Ft. Collins, Colo., (3rd Ed, 1982).

SUMMARY

The sugar juice clarification step of the present invention differs from processes conventional in sugar factories generally. It effects the removal of most of the suspended solids present in the raw juice without the use of a flocculating reagent.

While applicable to sugar processes generally, the invention is described in this disclosure with principal reference to the processing of sugar beets. The solid fraction recovered from sugar beet juice consists primarily of beet particles, coagulated proteins and other potentially valuable constituents. These solids thus constitute a value-added by-product, which would otherwise be lost with the discarded waste lime mud characteristic of conventional processes.

Clarification in accordance with this invention further results in a partial reduction of juice hardness. The clarified juice fraction has a low solids load, and is thus convenient to purify with high efficiency separation methods. Significantly less lime addition is required to treat the clarified juice prior to filtration. Filtration procedures are thereby simplified. Reducing the amount of lime in the system simplifies downstream factory operations, notably reducing the need for conventional lime-handling equipment. Moreover, the practice of this invention decreases both the emissions and solid waste disposal requirements of the factory.

The process involves subjecting the raw beet juice to heating to above 70° C., under stable sucrose conditions, for sufficient time to permit agglomerates formation (usually from about 10 to about 90 minutes, preferably about 40 minutes). The particle agglomerates can then be precipitated and separated from the solution by conventional settling or any other practical solid-liquid phase separation method.

Heating is preferably accomplished while holding the pH of the juice in the alkaline range, above about 7, to suppress inversion of sucrose. The purpose of such pH adjustment is merely to stabilize the sucrose, not to promote any chemical reaction. Solution pH can be adjusted with any compatible alkaline agent, particularly the alkali metal and alkaline earth metal oxides, carbonates and hydroxides. The hydroxides of sodium and potassium are presently preferred, for reasons of availability, economy and effectiveness.

In practice, precipitation can sometimes be promoted with little or no pH adjustment. Higher solution pH values tend to result in an increased amount of precipitation. The amount of chemicals utilized to adjust solution pH is desirably controlled to the minimum effective level, thereby to maintain the highest feasible purity of the sucrose.

Minor amounts of bactericide, such as ammonium bisulfate, alkali metal bisulfate, sulfur dioxide, peracetates or other commercially available reagents having bacteriocidal activity and approved by the FDA for use in the sugar industry, may be used to reduce the risk of sucrose degradation due to bacterial activity.

A notable advantage of this invention is that agglomeration may be effected in the absence of a flocculating reagent. It is generally assumed that some chemical, such as lime or flocculent, should be added to raw juice to initiate precipitation of suspended solids. It is thus quite unexpected that heating and sedimentation, used in sequence, effect the removal of 60–90% of suspended solids out of a feed stream. The resulting clarified juice contains only minor amounts of suspended solids, usually within the range of about 0.1–0.5%, by volume. It is thus suitable for further direct purification procedures of a simplified character, as compared to current practice.

Within the context of this disclosure, "absence of flocculating reagent" is intended to exclude "non-trivial" or "effective" amounts of such chemicals. The present process will tolerate flocculating reagents at levels below those which would adversely affect membrane filtration, for example, but no benefit appears to derive from the presence of such reagents.

Significantly, the agglomeration or flocculation of this invention is mechanistically dissimilar from that induced through the use of flocculants. The precipitation achieved through the practice of this invention can be regarded as "auto" coagulation, in that it occurs without chemical addition, and preferably without mixing or other modes of agitation. Mixing is avoided because the aggregates formed are very fragile in nature. In this connection, the use of fractal distributors for the introduction of juice to a clarifier is highly preferred. Such devices minimize turbulent mixing at the feed entry regions. The aggregates of this invention are chemically and physically dissimilar from those resulting from conventional liming and carbonation procedures.

The clarification approach of this invention may be embodied as the entire first step of juice purification in a sugar factory. Alternatively, the clarified juice of this invention constitutes a suitable feed material for pressure, vacuum or membrane filtration. In any case, removal of most of the suspended solids by the procedures of this invention significantly simplifies subsequent juice treatment.

The disclosures of commonly assigned U.S. Pat. No. 5,354,460 and Ser. No. 726,393, filed on Oct. 4, 1996 by Michael M. Kearney for "FRACTAL CASCADE AS AN ALTERNATIVE TO INTER-FLUID TURBULENCE" are incorporated by reference as a portion of this disclosure for their teachings concerning the benefits of low turbulence fractal distribution. The use of fractal distribution in the practice of this invention significantly reduces turbulent mixing of the light, fragile particles produced by the disclosed treatments.

BRIEF DESCRIPTION OF THE DRAWINGS

In the drawings, which illustrate what is currently regarded as the best mode for carrying out the invention.

DETAILED DESCRIPTION OF THE ILLUSTRATED EMBODIMENT

Figure 1:
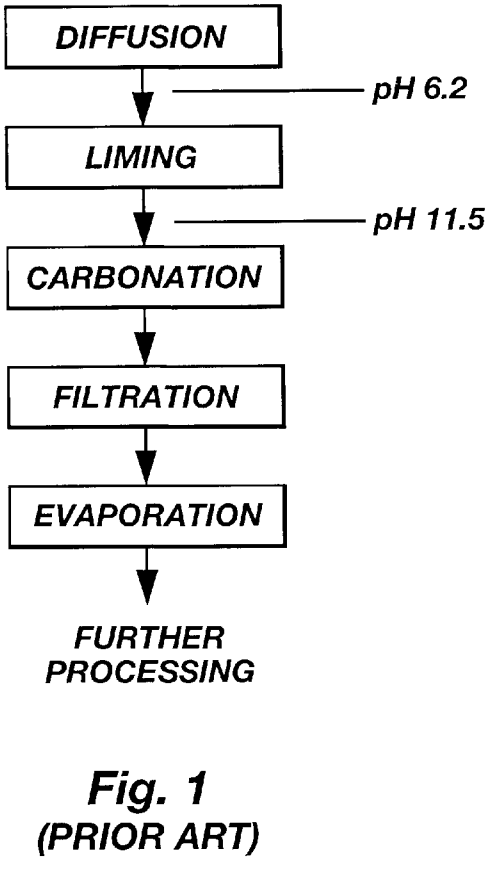
Fig. 1 (PRIOR ART)
FIG. 1 is a typical flow sheet depicting a conventional process over which this invention constitutes an improvement.

FIG. 1 illustrates a typical conventional sugar factory flow sheet, including the sequential steps of diffusion, liming, carbonation, filtration and evaporation to produce a concentrated juice suitable for further processing steps to recover refined sugar. The pH of the diffusion juice, following the diffusion step, is typically between about 6.2 and about 6.5. The conventional liming step raises the pH of this juice to between about 11.0 and about 11.5.

Figure 2:
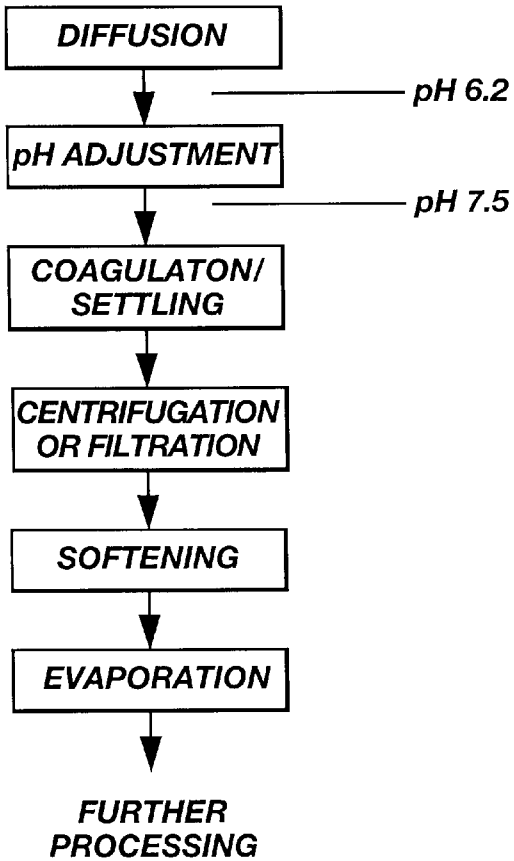
FIG. 2 is a flow sheet describing an embodiment of the invention.
Figure 3:
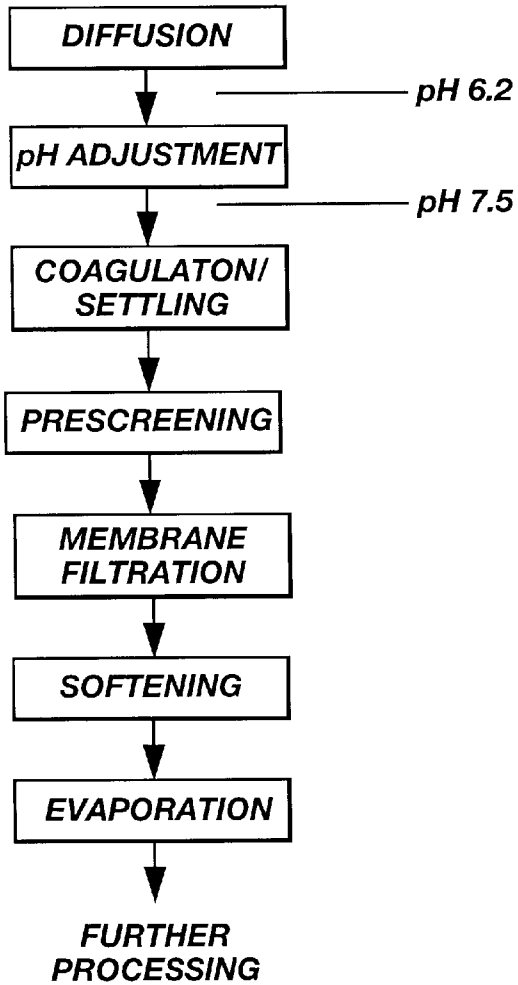
FIG. 3 is a flow sheet describing an alternative embodiment of the invention.

FIGS. 2 and 3 illustrate alternative embodiments of this invention which avoids the liming step and its resulting high pH levels. Following diffusion, the pH of the juice is adjusted to above about 7 to prevent sucrose degradation. The pH of the juice is held well below conventional levels, however; generally below about 9.0, and more typically below about 8.5 to maintain acceptable juice purity. The preferable pH level for juice subjected to the coagulation/settling step of this invention is within the range of about 7.0 to about 7.5. Lower levels permit unacceptable levels of sucrose inversion. Higher levels are associated with increased chemical costs and decreased product purity.

The preferred operating temperature for the phase separation procedures illustrated by FIGS. 2 and 3 is within the range of about 90 to about 95° C., although temperatures between about 70° C. and the boiling point of the juice are operable. Of course, operating at near the boiling point is generally impractical because of the risk of pump cavitation. Increasing the operating temperature reduces juice viscosity, thereby enhancing sedimentation, but increasing the risk of sucrose inversion at low pH levels. Higher temperatures also reduce the risk of bacterial infection.

EXAMPLE

Raw beet juice obtained from A conventional diffusion operation contained 13% solids on a dry weight basis (D.S.) and 2.5% volume suspended solids. Juice pH was adjusted to 7 with sodium hydroxide solution. The juice was then quickly heated to 85° C. Fast formation and precipitation of particles was observed. The particles were allowed to settle for 40 minutes. The top and bottom layers of the juice were then separated. Samples were spun in the laboratory centrifuge for 5 minutes to determine the level of suspended solids. The top layer contained 0.2% volume suspended solids and the bottom layer contained about 50% solids by volume.

The process illustrated by FIG. 2 utilizes either or both centrifuging or filtering procedures for phase separation. The resulting clarified juice is then subjected to a conventional softening procedure prior to the evaporation step. The alternative procedure of FIG. 3 utilizes prescreening and membrane filtration, which may include micro-, ultra- or nano-filtration, for phase separation.

A notable advantage of the auto coagulation procedure of this invention is the significantly reduced load imposed upon the softening step by avoidance of conventional liming procedures.

Reference in this disclosure to certain detail of the illustrated embodiments is not intended to limit the scope of the appended claims, which themselves recite those features regarded as important to the invention.

What is claimed is:

1. A process for clarifying the raw diffusion juice of a sugar factory, comprising:

heating said diffusion juice to above about 70° C.;

holding said juice above about 70° C. in the absence of a flocculating reagent, for a period of time between about 10 minutes and 90 minutes, to permit significant agglomeration of solids suspended in said juice; and thereafter, subjecting said juice to a phase separation procedure, whereby to recover a clarified juice fraction and a solids fraction.

2. A process according to claim 1, including the step of maintaining the pH of said juice within the alkaline range while holding said juice above about 70° C., whereby to prevent inversion of sucrose comprising said juice.

3. A process according to claim 1, wherein said juice is heated to and maintained within the range of about 70° C. to below about the boiling point of said juice until significant agglomeration has occurred.

4. A process according to claim 1, including the step of maintaining the pH of said juice within the alkaline range while holding said juice above about 70° C., whereby to prevent inversion of sucrose comprising said juice.

5. A process according to claim 1 including the step of treating said juice with an effective amount of a bactericide, whereby to reduce the risk of sucrose degradation due to bacterial activity.

6. A process according to claim 5, including the step of maintaining the pH of said juice within the alkaline range while holding said juice above about 70° C., whereby to prevent inversion of sucrose comprising said juice.

7. A process according to claim 5, wherein said juice is heated to and maintained within the range of about 70° C. to below about the boiling point of said juice until significant agglomeration has occurred.

8. A process according to claim 7, including the step of maintaining the pH of said juice within the alkaline range while holding said juice above about 70° C., whereby to prevent inversion of sucrose comprising said juice.

9. A process according to claim 1, wherein said phase separation procedure comprises precipitation of a solid precipitant and subsequent solid-liquid phase separation.

10. A process according to claim 9, wherein said solid precipitant comprises beet particles and coagulated proteins.

11. A process for clarifying the raw diffusion juice of a sugar factory, comprising:

adjusting the pH of said juice to within the alkaline range below about 11.5;

heating said diffusion juice to above about 70° C.;

holding said juice under conditions suitable to promote settling, and above about 70° C. in the absence of a flocculating reagent for a period of time in excess of about 10 minutes, and sufficient to permit significant agglomeration and precipitation of solids suspended in said juice; and thereafter, subjecting said juice to a phase separation procedure, whereby to recover a clarified juice fraction and a solids fraction.

12. A process according to claim 11, including the step of maintaining the pH of said juice within the range of about 7 to about 9 while holding said juice within the range of above about 70° C. and below about the boiling point of said juice, whereby to prevent inversion of sucrose comprising said juice.

13. A process according to claim 11, wherein said juice is heated to and maintained within the range of about 70° C. to about 95° C. until significant agglomeration has occurred.

14. A process according to claim 13, including the step of maintaining the pH of said juice within said range while holding the temperature of said juice within the range of about 90° C. to about 95° C., whereby to prevent inversion of sucrose comprising said juice.

15. A process according to claim 11, including the step of treating said juice with an effective amount of a bactericide, whereby to reduce the risk of sucrose degradation due to bacterial activity.

16. A process according to claim 15, including the step of maintaining the pH of said juice within the range of about 7 to about 9 while holding said juice within the range of above about 70° C. and below about the boiling point of said juice, whereby to prevent inversion of sucrose comprising said juice.

17. A process according to claim 15, wherein said juice is heated to and maintained within the range of about 70° C. to about 95° C. until significant agglomeration has occurred.

18. A process according to claim 17, including the step of maintaining the pH of said juice within said range while holding the temperature of said juice within the range of about 90° C. to about 95° C., whereby to prevent inversion of sucrose comprising said juice.

19. A process according to claim 18, including the step of maintaining the pH of said juice within the range of about 7 to about 9 while holding the temperature of said juice within said range.

* * * * *